United States Patent [19]

Petersen

[11] 4,380,941

[45] Apr. 26, 1983

[54] DETACHABLE JAW-LOCKING DEVICE FOR AN ADJUSTABLE PIPE WRENCH

[76] Inventor: Hyrum D. Petersen, 438 E. Barnard, Centerville, Utah 84014

[21] Appl. No.: 200,964

[22] Filed: Oct. 27, 1980

[51] Int. Cl.[3] ..... B25B 13/58

[52] U.S. Cl. ..... 81/180 R

[58] Field of Search ..... 81/53 A, 180 R, 180 C, 81/180 D, DIG. 9

[56] References Cited

U.S. PATENT DOCUMENTS

| | | | |
|---|---|---|---|
| 1,544,779 | 7/1925 | Scott | 81/180 R X |
| 1,635,031 | 7/1927 | Champion | 81/180 R X |
| 3,613,486 | 10/1971 | Chapman | 81/180 R |

*Primary Examiner*—James G. Smith

*Attorney, Agent, or Firm*—Thorpe, North & Western

[57] ABSTRACT

A device for enclosing the open end of an adjustable wrench and for locking the jaws of the wrench to a pipe grasped therebetween. The device includes an extendable locking member which is attached to the wrench at an attachment end by attaching means such as a harness and at a locking end by securing means such as a catch which is slidably fixable along the wrench. One end of the extendable locking member is secured to the movable jaw and the other to the fixed portion of the adjustable wrench so that the extendable locking member spans the open end of the wrench when in a closed position with the jaws. The adjustable wrench is secured to the pipe or other structure to be manipulated, and the extendable locking member is then secured across the open end of the wrench jaws. When the work is completed, the locking member is released, allowing removal of the wrench from the pipe.

2 Claims, 5 Drawing Figures

DETACHABLE JAW-LOCKING DEVICE FOR AN ADJUSTABLE PIPE WRENCH

BACKGROUND OF THE INVENTION

1. Field of the Invention

The present invention relates to a device for locking the jaws of an adjustable wrench around a pipe to minimize the possibility that the wrench will slip or fall loose from the pipe. More particularly, the invention relates to a detachable jaw-locking device for a pipe wrench having an extendable locking member which extends across the jaw opening of the wrench to enclose the open end of the wrench and lock the jaws around the pipe.

2. The Prior Art

The use of pipe wrenches at substantial heights by workmen on a construction site is a common occurrence. The fact that such wrenches have an open side and rely on applied pressure from the user to maintain a grip on the pipe, creates serious safety hazzards to both workmen and other persons below the work site. Often, the wrenches are carelessly released or may simply be left engaged around a pipe or other object. In either case, the wrenches can easily slip, or otherwise become dislodged and fall. This risk is further exaggerated by the substantial weight of the pipe wrench as compared with other wrenches or tools of common use.

U.S. Pat. Nos. 504,232 and 2,517,041 disclose wrenches having spring biased jaws for better gripping, but neither was intended to solve the additional problems described hereabove. Even though spring biased jaws help lessen the risk of dislodging a pipe wrench engaged around a pipe, the jaw opening of the engaged wrench provides a potential escape route for any such wrench when released, jarred or otherwise disturbed.

From the foregoing, it will be appreciated that what is needed in the art is a device which is capable of enclosing the open end of an adjustable pipe wrench and firmly locking its jaws around a pipe, regardless of the size of the jaw spread. Such an invention is described herebelow.

BRIEF SUMMARY OF THE INVENTION

The detachable jaw-locking device for an adjustable pipe wrench includes an extendable locking member capable of extending across the open end of the wrench. The extendable locking member has an attachment end and a locking end. Either end of the extendable locking member may be attached to the movable jaw of the adjustable wrench, while the other end is attached to the fixed portion of the wrench. The attachment end is anchored to the wrench by attaching means, such as a harness which conforms to the shape of the wrench at the site of attachment and is detachable therefrom. The locking end is attached to the wrench by securing means, such as a sliding catch, so that fixation of the locking end at several positions along the wrench is possible. The locking end can subsequently be detached from the securing means when the jaw-locking device is not in operation.

The respective attaching and locking means are disposed on opposing sides of the open end of the wrench. This allows one to stretch the extendable locking member across the open end of the wrench and secure the locking end to the wrench. With the locking end fixed to the wrench, the jaws of the wrench and the extendable locking member form an enclosure around a pipe grasped in the jaws. When not in use, the locking end is released from the securing means and the attaching means is detached from the wrench to allow the device to be completely removed from wrench and stored if desired.

It is therefore an object of the present invention to provide a jaw-locking device for an adjustable pipe wrench that will completely enclose the open end of the wrench and provide tension between the jaws of the wrench against the grasped pipe to prevent the wrench from slipping free from the pipe.

It is another object of the present invention to provide a jaw-locking device for an adjustable pipe wrench that can be used at substantial heights on a construction site to eliminate the risk of the wrench falling when being used by a workman or when left unattended around a pipe.

It is a further object of the present invention to provide a jaw-locking device for an adjustable pipe wrench that is detachable from the wrench when not in use.

It is yet another object of the present invention to provide a jaw-locking device for an adjustable pipe wrench that can be adjusted to accommodate any jaw spread in firmly securing the wrench to the pipe.

It is still another object of the present invention to provide a jaw-locking device for an adjustable pipe wrench that is easy and inexpensive to manufacture and assemble.

It is yet still another object of the present invention to provide a jaw-locking device that can be easily and readily attached to almost any ordinary adjustable pipe wrench.

These and other objects will be apparent to one skilled in the art in view of the following specification, taken with the accompanying drawing, wherein like numerals designate like parts throughout.

DETAILED DESCRIPTION OF THE INVENTION

Figure 1:
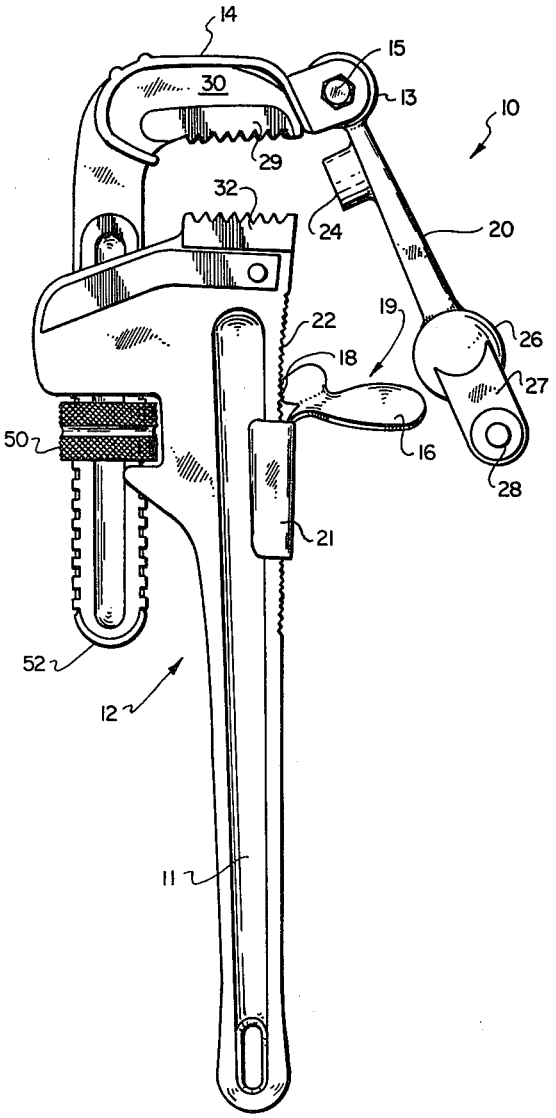
FIG. 1 is a side plan view of a first embodiment of the detachable jaw-locking device shown attached to an adjustable pipe wrench.
Figure 2:
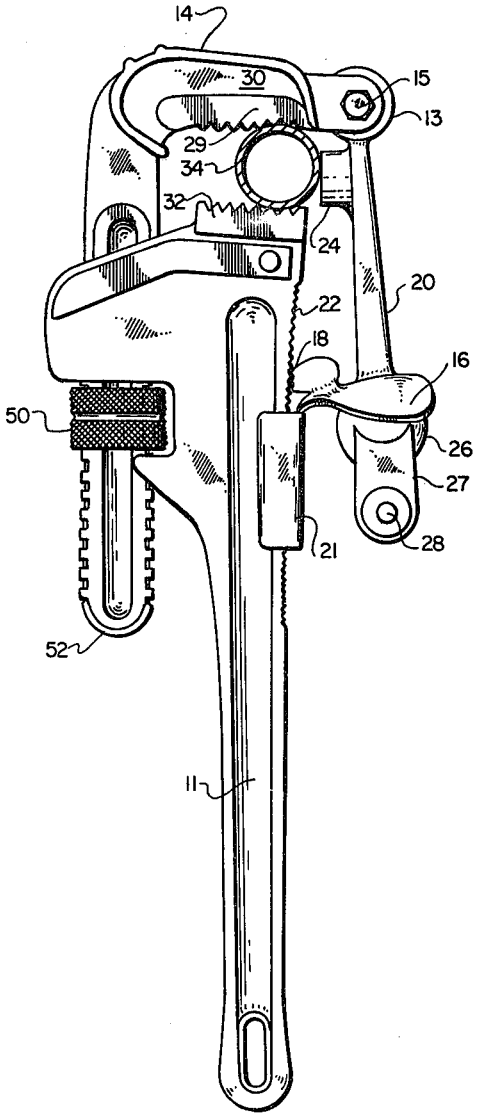
FIG. 2 is a side plan view of FIG. 1 showing the jaw-locking device in operation, being in a closed position with the jaws of the adjustable wrench and locking the jaws to a pipe grasped therebetween.

The first embodiment of the detachable jaw-locking device of the present invention, shown in FIGS. 1 and 2, is adapted to be used with an adjustible pipe wrench which has a movable upper jaw.

The jaw-locking device, generally designated 10, is attached to the movable upper jaw 30 of the adjustable wrench, generally designated 12, by a metal harness 14. Harness 14 is curved to conform to the shape of upper jaw 30 and fits snugly around upper jaw 30, being incapable of slipping off the end 29 thereof. Harness 14 can be removed from upper jaw 30 by turning adjusting gear 50 to raise upper jaw 30 and widen the gap between upper jaw 30 and a lower fixed jaw 32 until upper jaw 30 is free from the rest of the wrench structure 12. Harness 14 can then be removed by slipping it off end 52 of upper jaw 30. Upper jaw 30 can subsequently be returned to its place in the wrench structure 12 without the harness 14 and the structure of locking-device 10 attached thereto, shown in FIG. 1. It will be apparent to one skilled in the art that various other detachable attaching means may be used in lieu of harness 14.

An extendable locking member 20 is pivotably connected at its attachment end 13 to harness 14 by a bolt 15. Locking member 20 is generally made of rubber or other elastic material, but other compositions may be used as will be explained later. Locking member 30 has a locking end 27 which further comprises a locking ball 26. Locking ball 26 is an enlarged portion of locking member 20 which cooperates with a sliding catch 16 to receive and secure locking end 27 and maintain locking member 20 in a closed position with jaws 30 and 32 as shown in FIG. 2.

Catch 16 is a U-shaped piece of metal having a slot 19 narrower than the diameter of locking ball 26 and is slidably mounted to the fixed portion 11 of wrench 12. When locking member 20 is stretched into a closed position as shown in FIG. 2, tension on stretched locking member 20 secures locking ball 26 firmly into the recess of catch 16. Catch 16 has a serrated portion 18 which can engage any one of a number of notches 22 after base 21 of catch 19 is slid along the wrench 12 to a desired position. When locking member 20 is in a closed position, catch 16 is biased so as to force serrated portion 18 into a notch 22. By releasing locking ball 26 from catch 16, catch 16 is again freely slidable and can be changed to a different position along the edge of the fixed portion 11 of the wrench 12. Catch 16 is thus slidably fixable along the wrench 12.

A handle 28 or other gripping means is mounted at locking end 27 to facilitate the grasping and stretching of locking member 20.

Locking member 20 also has mounted to it a rubber stop 24 which extends from locking member 20 toward jaws 30 and 32 when locking member 20 is in a closed position with the jaws 30 and 32. As best shown in FIG. 2, rubber stop 24 butts against a pipe 34 grasped between jaws 30 and 32 and impedes movement of pipe 34 away from the jaws 30 and 32.

The operation and usage of the jaw-locking device will be readily apparent. The harness 14 is first put into place by removing upper jaw 30 from the wrench assembly, slipping harness 14 over the end 52 of upper jaw 30, reattaching upper jaw 30 to the wrench assembly, and pulling the harness 14 towards end 29 to secure harness 14 in the position shown in FIG. 1. As end 19 is approached, upper jaw 30 increases in width, thus preventing harness 14 from escaping from upper jaw 30.

Referring now to FIG. 2, upper jaw 30 is then adjusted to permit jaws 30 and 32 to firmly grasp the pipe 34. Catch 16 is moved to a position along the wrench 12 somewhat lower than locking ball 26. The user grasps handle 28 and stretches rubber locking member 20 in the direction indicated by the arrow in FIG. 1 until locking ball 26 extends beyond catch 16. The user then lowers locking member 20 into slot 19 of catch 16 and releases the handle 28 so that locking ball 26 seats securely in the recess of catch 16, being held in place by the tension on locking member 20. Rubber stop 24 is also now in place against pipe 34 to help prevent movement of the pipe 34 away from jaws 30 and 32.

While in this closed position illustrated in FIG. 2, locking member 20 serves two important functions. First, the locking member 20 itself forms a complete enclosure about the pipe 34 with jaws 30 and 32 and eliminates the possibility of the wrench 12 falling, even if the pipe 34 does manage to slip away from jaws 30 and 32. Secondly, the tension on stretched locking member 20 creates tension between jaws 30 and 32 causing them to lock firmly around pipe 34 and greatly reduce the risk of the pipe 34 ever slipping out of jaws 30 and 32. These two features combine to yield a novel enclosing and locking apparatus that synergistically serves as a safety device for any adjustable wrench.

It should be noted, however, that variations are possible without departing from the scope and spirit of the invention. For example, a spring-like locking member could be used which requires no adjustable securing means, but simply means for attachment on each side of the open end of the wrench. Tension on the spring would simply increase as the jaw spread is increased; there would be no means for adjusting the tension on the locking member at any given jaw spread as is possible with a sliding catch. Thus, although an adjustable securing means is not essential, it is often highly desirable when the locking member is made of a high tension material such as rubber.

Also, instead of using an elastic locking member, two coupled rigid components could be employed. The components would be detachably fixable at several positions along each other, so as to allow the user to adjust the total length of the component assembly and accomodate the jaw spread to be used.

Also possible as an extendable locking member is a rigid dual component system utilizing fluid pressure to adjust the composite length of the assembly. Thus, it will be appreciated that these and many other variations of the extendable locking member are possible.

To release the closed locking member 20, the user merely pulls back on handle 18 to free locking ball 26 from catch 16, moves locking member 20 away from catch 16, and releases the tension on handle 18 and locking member 20. Removal of the entire jaw-locking device 10, excepting catch 16, is then possible by detaching harness 14 from upper jaw 30 as previously explained. Catch 16 remains attached to the wrench 12 and is initially installed by pinching the bases 21 of catch 16 against the edge of fixed portion 11 of the wrench 12 with a pair of pliers or other suitable tool.

Figure 3:
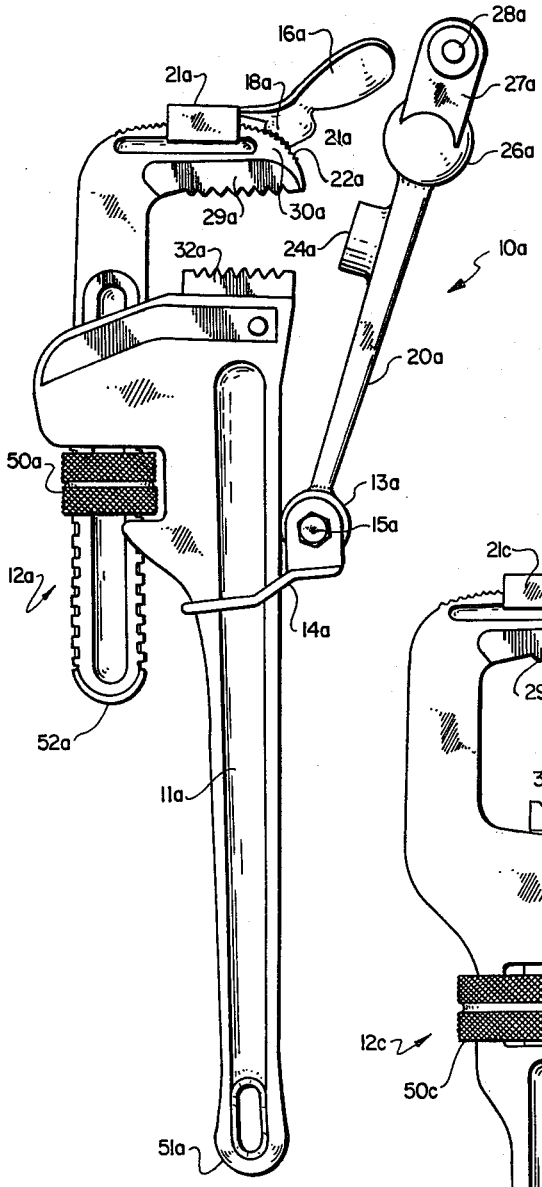
FIG. 3 is a side plan view of a second embodiment of the detachable jaw-locking device shown attached to an adjustable pipe wrench.

A second embodiment of the present invention is illustrated in FIG. 3. This embodiment is also adapted to be used with an adjustable pipe wrench which has a movable upper jaw 10*a*, but the positions of the harness 14*a* and the sliding catch 16*a* have been reversed when compared with the first embodiment. The embodiment of FIG. 3 functions similarly to the embodiment of FIGS. 1 and 2, but a few distinctions are notable.

First, the sliding catch 16*a* is freely slidable along the top of upper jaw 30*a*. Serrated portion 18*a* engages one of notches 22*a* when locking member 20*a* is in a closed position. Harness 14*a* is configurated to conform to the shape of the fixed portion 11*a* of the wrench 12*a* to which it is attached. Harness 14*a* slips over the end 51*a* of fixed portion 11*a* and is secured to fixed portion 11*a* by pulling the harness 14*a* upward along fixed portion 11*a* to a position of larger cross-sectional area. To remove harness 14*a*, the user merely pulls downward on the harness 14*a* until it becomes loosened and then slides the harness 14*a* off of end 51*a*.

Figure 4:
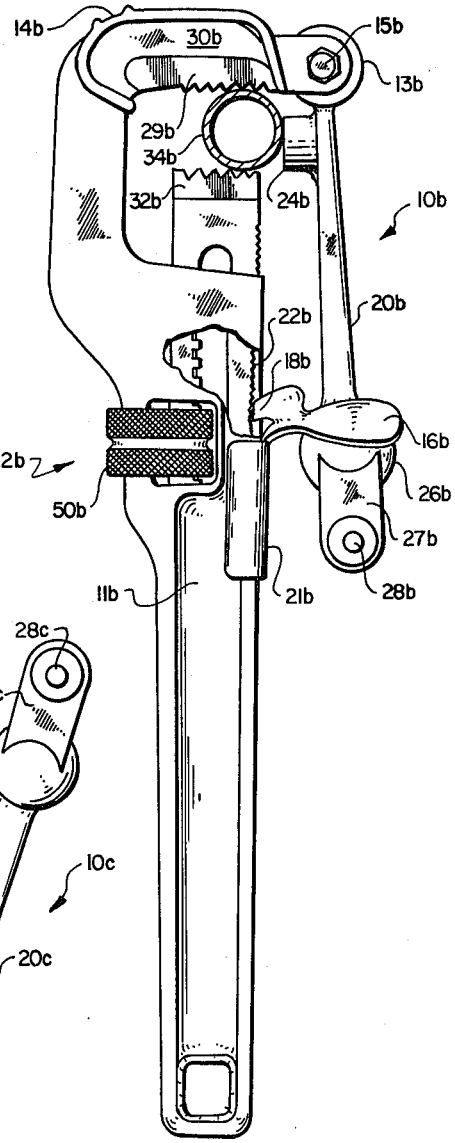
FIG. 4 is a side plan view of a third embodiment of the detachable jaw-locking device shown attached to an adjustable pipe wrench with a movable bottom jaw.

A third embodiment of the present invention is illustrated in FIG. 4. This embodiment also functions similarly to the embodiment of FIG. 1, but is adapted to be used with an adjustable pipe wrench which has a movable lower jaw 32*b*. The spread of jaws 30*b* and 32*b* is adjusted by turning adjusting gear 50*b* to move lower jaw 32*b* up or down. The upper jaw 30*b* is now part of the fixed portion 11*b* of the wrench.

The harness 14*b* is adapted to slip over end 29*b* of upper jaw 30*b*. The harness 14*b* becomes secure when downward pressure is applied at 15*b* by stretching locking member 20*b* toward catch 16*b*.

Catch 16*b* has a T-shaped base that is inserted into a T-shaped slot 36*b* formed along the edge of movable lower jaw 32*b*. Although not shown in FIG. 4, catch 16*b* also has a serrated portion which engages with notches located at the bottom of slot 36*b*, much in the same way as the serrated portions 18 and 18*a*, and notches 22 and 22*a* of the first and second embodiments of FIGS. 1 and 3, respectively.

Figure 5:
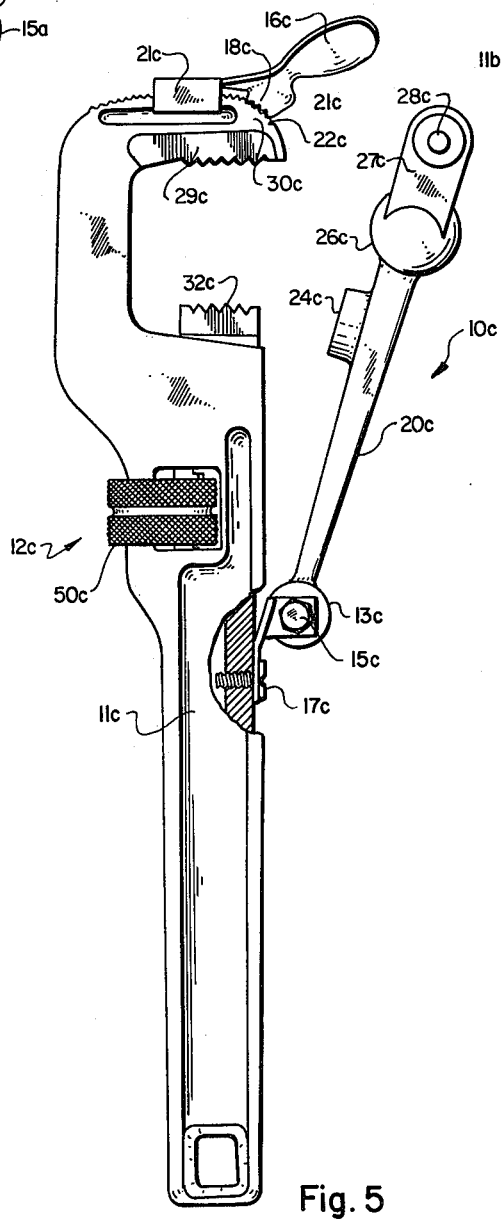
FIG. 5 is a side plan view of a fourth embodiment of the detachable jaw-locking device shown attached to an adjustable pipe wrench with a movable bottom jaw.

A fourth embodiment of the present invention is shown in FIG. 5. This embodiment is adapted to be used with an adjustable pipe wrench having a movable lower jaw 32*c*, like the third embodiment of FIG. 4, but the respective positions of the attaching and securing means of the third embodiment have been reversed in this fourth embodiment.

Catch 16*c* is slidably attached to fixed upper jaw 30*c*. Serrated portion 18*c* and notches 21*c* cooperate to fix catch 16*c* at a desired position along the top of upper jaw 30*c* when tension is applied to locking member 20*c*, much in the same manner as with the previously described embodiments.

Locking end 13*c* is attached to the edge of movable lower jaw 32*c* by a plate 15*c* and a screw 17*c*. Locking end 13*c* can be detached by unscrewing screw 17*c* and removing plate 15*c* to free locking end 13*c*.

The operation and function of the jaw-locking devices represented by embodiments 2, 3 and 4 are nearly identical to that of the first embodiment previously described. It will be appreciated that the present invention may also be applied to an adjustable pipe wrench with both jaws being movable. The respective attaching and securing means are simply mounted on opposing jaws so that the extendable locking member will enclose the open end of the wrench and lock the jaws around the pipe grasped therebetween. This device would function largely in the same manner as the other embodiments disclosed herein.

The previous descriptions of the preferred embodiments are given by way of example only and should not be considered as the only structure suitable for carrying out the subject invention. It will be apparent that numerous variations of the foregoing disclosure are possible without departing from the scope and spirit of the hereinafter claimed subject matter, which subject matter is to be regarded as the invention.

What is claimed and desired to be secured by U.S. Letters Patent is:

1. A device adapted for attachment to an adjustable wrench for enclosing the open end thereof, comprising:

an extendable locking member having an attachment end and an enlarged locking end and being adapted with means to permit releasable fixation of said extendable locking member at different positions on said adjustable wrench in a closed position across the open end of said adjustable wrench;

means for attaching said attachment end to said adjustable wrench;

means for securing said locking end to said adjustable wrench and permitting subsequent detachment of said locking end therefrom, said securing means comprising a U-shaped catch having a slot narrower than the enlarged locking end, said catch being adapted for slideable fixation at various positions along said adjustable wrench, said catch being capable of receiving said enlarged locking end in seated configuration with the extendable locking member in a closed position with respect to the jaws of the adjustable wrench; and said respective attaching and securing means being adapted for attachment to the wrench on opposing sides of its open end so as to allow extension and locking of said extendable locking member across the open end, despite changes in jaw opening size.

2. A device for enclosing the open end of an adjustable wrench as defined in claim 1, further comprising a stop mounted to said extendable locking member, said stop projecting from said extendable locking member toward the open jaws of said adjustable wrench when said extendable locking member is in a closed position therewith, said stop being capable of butting against a pipe grasped in the jaws of said adjustable wrench to impede movement of said pipe away from said jaws.

* * * * *